United States Patent [19]

Schon et al.

[11] Patent Number: 5,004,479

[45] Date of Patent: Apr. 2, 1991

[54] METHANOL AS COSURFACTANT FOR MICROEMULSIONS

[75] Inventors: Steven G. Schon, Philadelphia; Edward A. Hazbun, Media, both of Pa.

[73] Assignee: Arco Chemical Technology, Inc., Wilmington, Del.

[21] Appl. No.: 872,371

[22] Filed: Jun. 9, 1986

[51] Int. Cl.[5] ..... C10L 1/32

[52] U.S. Cl. ..... 44/302; 44/385

[58] Field of Search ..... 44/51, 53, 57

[56] References Cited

U.S. PATENT DOCUMENTS

| | | | |
|---|---|---|---|
| 2,111,100 | 3/1938 | Kokatnur | 44/51 |
| 3,527,581 | 9/1970 | Brownawell et al. | 44/51 |
| 4,083,698 | 4/1978 | Wenzel et al. | 44/51 |
| 4,395,266 | 7/1983 | Han | 44/51 |
| 4,451,265 | 5/1984 | Schwab | 44/51 |
| 4,451,267 | 5/1984 | Schwab et al. | 44/51 |
| 4,565,547 | 1/1986 | Takada | 44/51 |

*Primary Examiner*—Jacqueline V. Howard

*Attorney, Agent, or Firm*—William C. Long

[57] ABSTRACT

Stable microemulsion fuel compositions are provided which comprise (a) a hydrocarbon fuel such as diesel fuel, jet fuel, gasoline, or fuel oil; (b) water; and (c) cosurfactant combination of methanol and a fatty acid partially neutralized by a nitrogenous base. The compositions of the invention exhibit a high degree of phase stability even over wide variations of temperature, and reduce combustion emissions.

10 Claims, 4 Drawing Sheets

METHANOL AS COSURFACTANT FOR MICROEMULSIONS

CROSS-REFERENCE TO RELATED APPLICATION

Co-pending application Ser. No. 825,841, filed Feb. 4, 1986, relates to improved microemulsion fuel formulations which contain a cosurfactant system of tertiary butyl alcohol in combination with one or more of an amphoteric, cationic, anionic or nonionic surface active agent.

BACKGROUND OF THE INVENTION

1. Field of the Invention

The invention relates to microemulsion fuel compositions, and especially to such compositions having improved stability. Microemulsion fuel compositions have been of considerable interest since the combustion characteristics of such fuels have been found to be considerably different from those of the unmodified base fuels. Differences in combustion have been attributed to the presence of low molecular weight immiscible compounds such as water or methanol in the fuel as well as to the structural changes which accompany micellization of the surfactants which have been employed. The beneficial combustion changes include decreased smoke, particulate, and NOx emissions, and increased combustion efficiency. Improved fire resistance has also been demonstrated for microemulsion fuels containing water.

Microemulsion fuels are clear, stable, two-phase dispersions which form on simple stirring under appropriate conditions. They are comprised of a continuous non-polar hydrocarbon phase and a discontinuous polar phase. Because of the small droplet size of the discontinuous phase (2 to 200 nanometers) these fuels appear to be clear, one-phase systems.

2. Description of the Prior Art

The effects of water or alcohol addition on diesel engine performance is reviewed in "Water and Alcohol Use in Automotive Diesel Engines", DOE/CS/50286-4, published September 1985 by J.J. Donnelly, Jr. and H.M. White. The techniques for introducing water or alcohol into the engines covered by this review included (macro) emulsification, blending, fumigation, and dual-injection. The introduction of water or methanol was found to reduce emissions of smoke and particulates 20–60% while moderately reducing or increasing emissions of hydrocarbons and carbon monoxide. The addition of water also reduced levels of NOx 10–50%. This held true for all methods for introducing the water or methanol, and is attributed to a lowering of combustion temperatures (due to lower specific heating values and the heat absorbed to vaporize the water or alcohol droplets), and to a "microexplosion" phenomenon (the dispersed droplets vaporize explosively, more effectively atomizing the hydrocarbon fuel during combustion).

Water or methanol are most advantageously introduced into combustion engines when they are dispersed in the hydrocarbon fuel as a microemulsion. Since microemulsions are clear, stable, and pre-blended (prior to being stored in the fuel tanks), there is no need for additional equipment on the vehicle (as would be required for the other methods) such as additional fuel metering systems (dual-injection), agitators inside the fuel tanks (to prevent separation of macroemulsion fuels), injection or fumigation devices, etc. At the same time, the water or alcohol is still introduced into the engine in the desired physical for i.e., as microscopically fine liquid droplets (albeit dispersed as micelles in the hydrocarbon), preserving the ability to vaporize in the desired "microexplosion" manner.

An excellent general treatment of the subject of microemulsion fuel compositions is "Microemulsion Fuels: Development and Use" ORNL TM-9603, published March 1985 by A.L. Compere et al. Again, the presence of water or methanol (in microemulsions) led to large reductions in smoke and particulates, with slight increases in hydrocarbons and CO emissions. Depending on the type of engine used and operating conditions, NOx emissions were moderately decreased or increased.

Research sponsored by the U.S. Army Fuels and Lubricants Research Laboratory investigated the effect of water-in-fuel microemulsions on the fire-safeness of combat fuels. Several reports by W.D. Weatherford, Jr. and coworkers (AFLRL reports Nos. 111, 130, and 145) document the effectiveness of microemulsion diesel fuels containing 1–10% water inreducing the flammability—fuel pols were either self-extinguishing following ignition, or could not be ignited by an open flame. The Army formulations were prepared with deionized water, and surfactants without the addition of alcohols as cosurfactants. If low levels (200–500 ppm) of dissolved salts were present in the water, stable microemulsions could be formulated only by substantially increasing the percentage of surfactants, or by increasing the aromatic hydrocarbon content of the fuel. Even then, the amount of water that could be incorporated into the fuels were reduced when salts were present.

Various patents have issued which relate to microemulsion fuel compositions and which specifically relate to compositions comprised of hydrocarbon fuel, water, various alcohols, and surfactants. U.S. Pat. No. 4,406,519 for example, teaches a microemulsion fuel comprised of gasoline, methanol, water and a surfactant blend having a hydrophilic-lipophilic balance value of 3 to about 4.5. U.S. Pat. No. 4,083,698 describes fuel compositions which are water-in-oil emulsions and which comprise a hydrocarbon fuel such as gasoline or diesel fuel, water, a water-soluble alcohol such as gasoline or diesel fuel, water, a water-soluble alcohol such as methanol, ethanol or isopropanol, and certain combinations of surface-active agents. U.S. Pat. No. 4,451,265 describes microemulsion fuel compositions prepared from diesel fuel, water, lower water-miscible alcohols, and a surfactant system comprising N,N-dimethyl ethanolamine and a long-chain fatty acid substance. U.S. Pat. No. 4,451,267 teaches microemulsions prepared from vegetable oil, a C1–C3 alcohol, water and a lower trialkyl amine surfactant. This patent teaches the optional addition of 1-butanol as a cosurfactant for the purpose of lowering both the viscosity and the solidification temperature of the microemulsion.

In said co-pending application Ser. No. 825,841, filed Feb. 4, 1986, stable microemulsions are provided which employ tertiary butyl alcohol as a cosurfactant. It would, however, be advantageous to provide stable microemulsions with methanol as cosurfactant rather than tertiary butyl alcohol for reasons of cost and availability.

Methanol has been tried as a cosurfactant alcohol for anionic surfactants with limited success. U.S. Pat. No.

4,083,698 (col. 5, lines 5-10) claim that stable compositions are not feasible using long chain fatty salts (e.g., ammonium or sodium salts of oleic acid) as the surfactant and a water soluble alcohol (e.g., methanol) unless an additional nonionic surfactant is present. Compere, Griffith and Googin, in a paper submitted for publication, succeeded in producing a w/o microemulsion using a fatty acid surfactant and methanol as cosurfactant but it was stable only within a 5° C. temperature span. U.S. Pat. No. 4,451,265 claims that stable w/o formulations can be prepared using a fatty acid neutralized with dimethylethanolamine (DMEA) and a Cl-C3 alcohol as the cosurfactant. The examples in this patent used ethanol as the cosurfactant, and 1.05 moles of amine/mole of fatty acid surfactant; none of the examples used methanol as the cosurfactant. When we employed methanol as cosurfactant with fatty acids fully neutralized with DMEA, the water uptake was less than 2% in the final mixture.

The foregoing demonstrates the difficulties in dispersing water as in a fuel-continuous microemulsion when methanol is the cosurfactant for an anionic primary surfactant, in the absence of other classes of additional surfactants or cosurfactants, e.g., nonionics.

Nonetheless, it is highly desirable to use methanol instead of other alcohols as the cosurfactant. Methanol is much less costly than other alcohols, and is readily produced from both renewable resources (e.g., wood) and from fossil hydrocarbons (natural gas, coal, petroleum). For lowemissionss fuels, methanol has been shown to substantially reduce emissions, e.g., particulates, NOx, whereas other alcohols are not nearly as effective. In internal combustion engines, the presence of methanol reduces the tendency of the engine to "knock". Methanol also helps suppress the freezing point of formulations containing water.

SUMMARY OF THE INVENTION

In accordance with the present invention, microemulsion fuel stability is enhanced while the advantageous characteristics of the fuel are retained by incorporating in the microemulsion formulation an effective amount of a cosurfactant which consists of methanol in combination with fatty acid neutralized to a designated degree with a nitrogenous base. Thus, the novel fuel composition of this invention comprises (a) a hydrocarbon fuel such as diesel fuel, jet fuel, gasoline, fuel oil or the like; (b) water; and (c) a cosurfactant system of methyl alcohol in combination with a fatty acid neutralized as hereinafter described with a nitrogenous base. It should be noted that the degree of neutralization of the fatty acid needed to achieve microemulsion stabilization will vary significantly depending upon the particular nitrogenous base employed as will be fully described hereinafter.

THE DRAWINGS

FIGS. 1-4 graphically illustrate the amount of water which can be incorporated in stable microemulsions as a function of the degree of fatty acid neutralization using different nitrogenous bases in practice of the invention.

DETAILED DESCRIPTION

Figure 1:
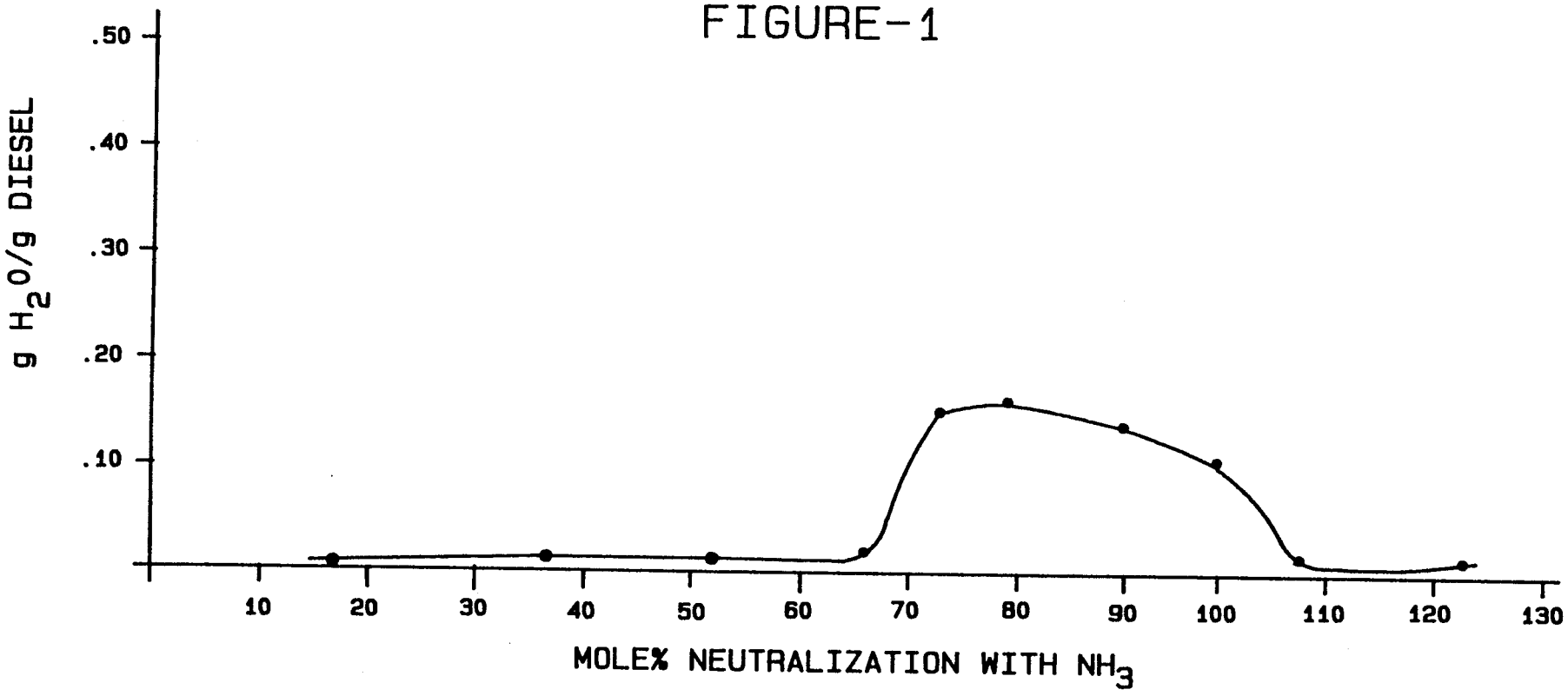
Figure 2:
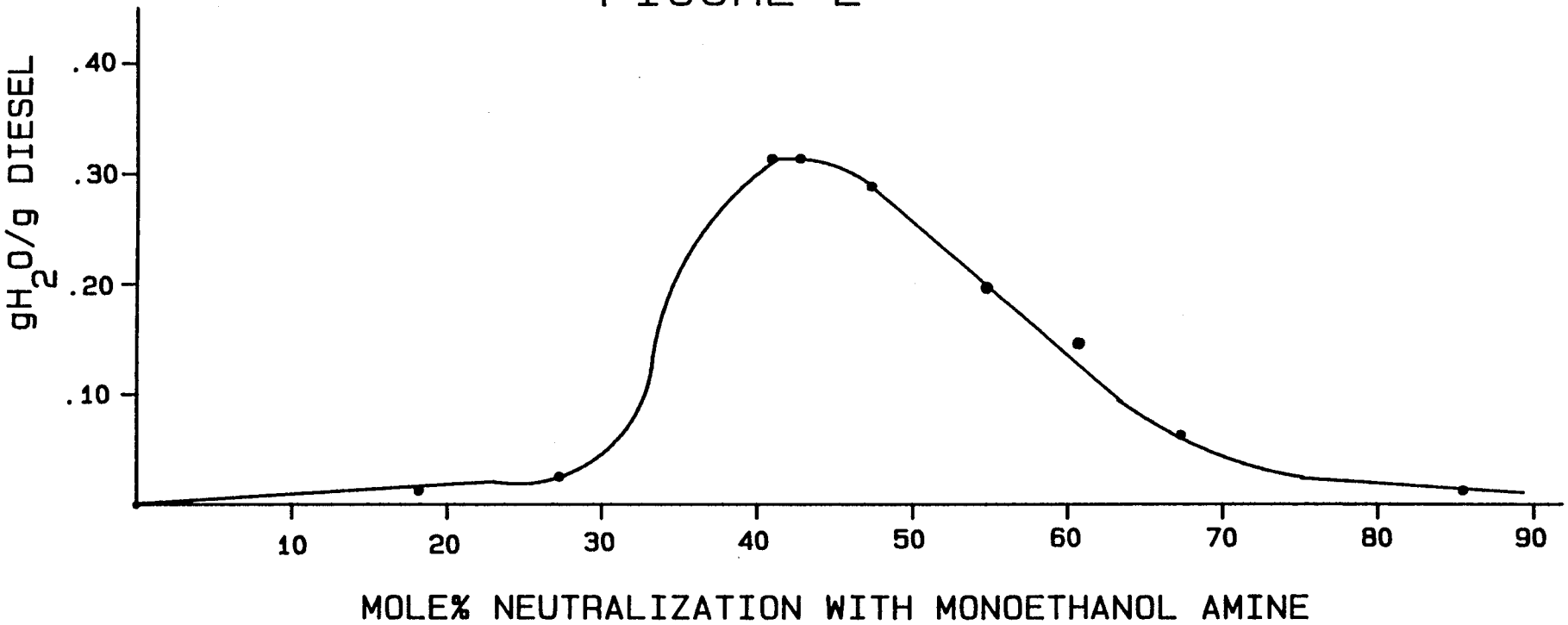

It has now been found that stable microemulsions can be formed which may contain high amounts of water where a cosurfactant system is used consisting essentially of methanol and fatty acid which has been partially neutralized with nitrogenous base.

The present invention is applicable generally to fuels which have previously been prepared in microemulsion form. Predominant among such fuels have been microemulsion diesel fuel formulations. However, the invention is applicable as well to microemulsions of jet fuel, fuel oil, gasoline, and the like. The invention is especially useful in preparation of distillate fuel microemulsions, that is, microemulsion of diesel fuel, jet fuel, fuel oil and the like.

The microemulsion fuel compositions of the invention are clear and stable and exhibit the single phase properties of hydrocarbon fuels. The fuel hydrocarbons comprise a continuous oil phase with water and soluble components as the dispersed phase.

Fuel hydrocarbons which form the continuous phase comprise mixtures of hydrocarbons such as those derived from petroleum. Diesel fuel hydrocarbons are preferred but the invention is also applicable to microemulsions form of jet fuel hydrocarbons, fuel oil hydrocarbons, gasoline hydrocarbons and the like. Compositions of the invention are readily used in place of the corresponding hydrocarbon fuels without the need for substantial changes in combustion apparatus, and demonstrate significantly improved stability characteristics over closely analagous prior compositions while retaining the important advantages demonstrated by prior formulations.

Fuel hydrocarbons comprise the predominant component of the microemulsion formulation. Generally speaking, the hydrocarbons comprise at least 50% by weight of the microemulsions and preferably comprise 60 to 90% by weight thereof.

Water forms a second essential component of the microemulsion formulations of the invention, generally in amounts of 2.0 to 40% by weight, preferably about 3 to about 30% by weight, and more preferably about 5 to about 20% by weight. Larger amounts of water further reduce emissions but adversely effect stability and power.

Essential to the invention is the provision of a cosurfactant system which consists of methanol and an anionic surfactant. Further, the anionic surfactant consists of one or more long chain fatty acid neutralized to a specified degree by a nitrogenous base.

Preferred fatty acids used in the invention are C8 to C22 saturated or unsaturated fatty acids, or mixtures thereof. For example, oleic acid, linoleic acid, stearic acid, isostearic acid, linolenic acid, palmitic acid, and the like can be used. The fatty acids may be pure or impure, and mixtures may be used such as vegetable fatty acids, tall oil acids, tallow acids, palm oil acids, and the like.

In accordance with the invention, the fatty acid surfactant component is neutralized with a nitrogenous base to within ±20 mol % of the optimum point for the particular acid and nitrogenous base system.

Necessary to practice of the invention is partial neutralization of the fatty acid with a nitrogenous base. Ammonia, amines, alkanolamines, having about 1 to 20 carbon atoms and the like are especially useful in the invention. Specific examples of preferred neutralizing agents include ammonia, ammonium hydroxide, (mono) ethanol amine, diethanol amine, triethanol amine, dimethyl ethanol amine, (mono) isopropanol amine, deisopropanol amine, triisopropanol amine, methyl amine, ethyl amine, dimethyl amine, ethylene diamine, trimethyl amine, and the like or mixtures thereof.

Inorganic neutralizing agents such as sodium hydroxide and potassium hydroxide are not effective for the production of surfactants which, with methanol, will produce stable microemulsions.

For each nitrogenous base neutralizing agent, there is an optimum degree of fatty acid neutralization, in the range 20 to 90% neutralization, for the preparation of the stable microemulsions. For a particular system, the optimum can be determined by a simple and straightforward series of tests. This is illustrated by reference to the following examples and to the drawings which accompany the present specification.

Each drawing graphically de amount of water which can be incorporated at room temperature to for a stable water in diesel fuel microemulsion with cosurfactant systems consisting of methanol together with partially neutralized fatty acid as a function of the degree of neutralization of the fatty acid by a nitrogenous base neutralizing agent.

In the following examples, the hydrocarbon base fuel used was Phillips D-2 reference grade diesel fuel. Methanol was reagent grade from Fisher Chemical. The fatty acid was Emersol 315, a commercial soy-derived fatty acid mixture from Emery Industries containing linoleic, oleic, linolenic, and palmitic acids, with a free acid content of 99 wt %. The water was deionized water.

In the examples, the following were added to a 4 dram glass vial containing a magnetic stirring bar: 4.65 g diesel fuel, 0.75 g methanol, 1.185 g fatty acid, and sufficient amounts of the appropriate base to achieve the desired level of neutralization of the fatty acid. The range of neutralization was from none to 125 mole % neutralization, based on free acid. The vials containing the mixtures were agitated at room temperatures using a magnetic stirrer. Water was added dropwise into the mixture until the mixture turned turbid or cloudy and did not clear, even when no more water was added and agitation was maintained for 5–10 mins. This indicated the transition point for the microemulsion, i.e., the phase boundary between microemulsion and unstable mixtures. The water uptake is defined as the weight of water at the phase boundary divided by the weight of the hydrocarbon (diesel) in the mixture.

The water uptake was determined at various levels of neutralization of the fatty acid for several neutralizers. The neutralizers that were tested included sodium hydroxide (NaOH), potassium hydroxide (KOH), ammonia (NH3), (mono) ethanol amine (MEA), dimethyl ethanolamine (DMEA), and (mono) isopropanolamine (MIPA). NaOH, KOH, and NH3 were added to the diesel/fatty acid/methanol as concentrated aqueous solutions, prior to titrations with water. The water in the aqueous bases was included in the calculated values of the water uptake.

Neither of the hydroxides (NaOH or KOH) were effective neutralizers when methanol was the cosurfactant. The water uptake was less than 0.03 g H2O/g diesel over the entire neutralization range.

All of the nitrogenous bases tested, i.e., NH3, MEA, DMEA, and MIPA, were very effective neutralizers over a narrow range of neutralization, as illustrated in FIGS. 1–4. The water uptake and the effective range of neutralization for these bases are summarized in Table 1. The optimum neutralization value for each base is also given.

Figure 3:
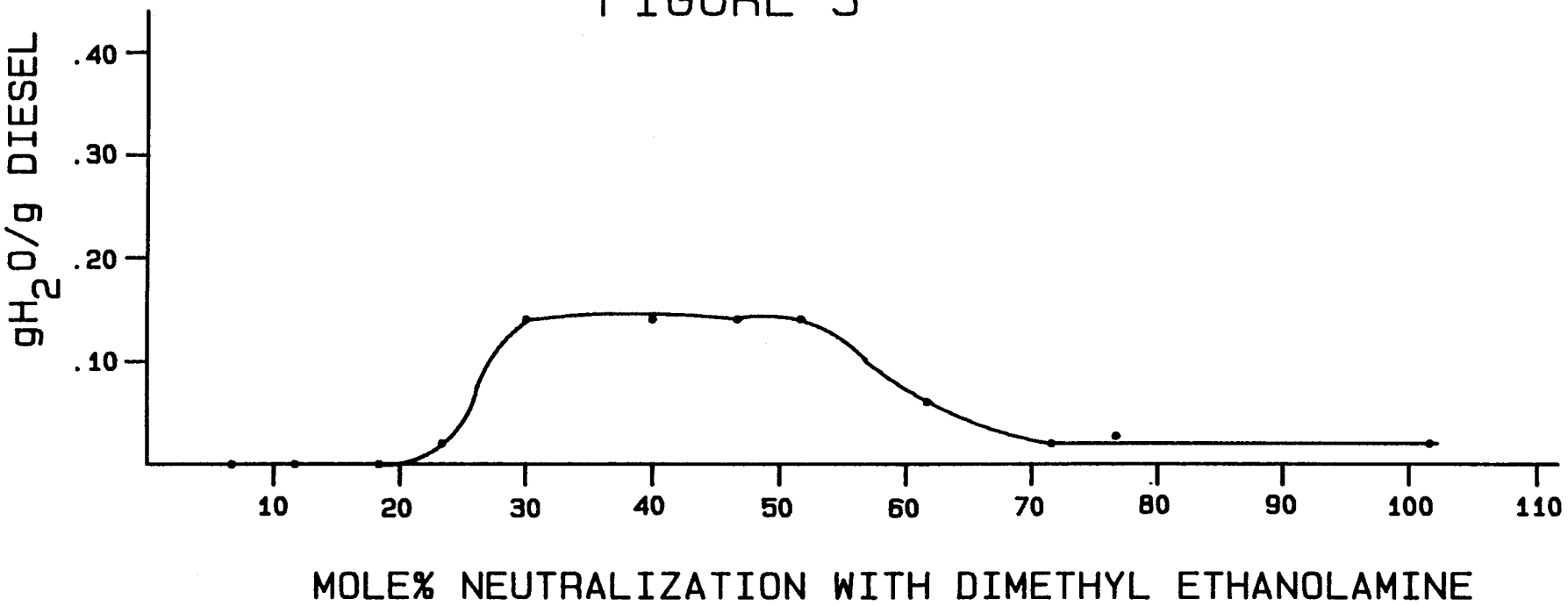
Figure 4:
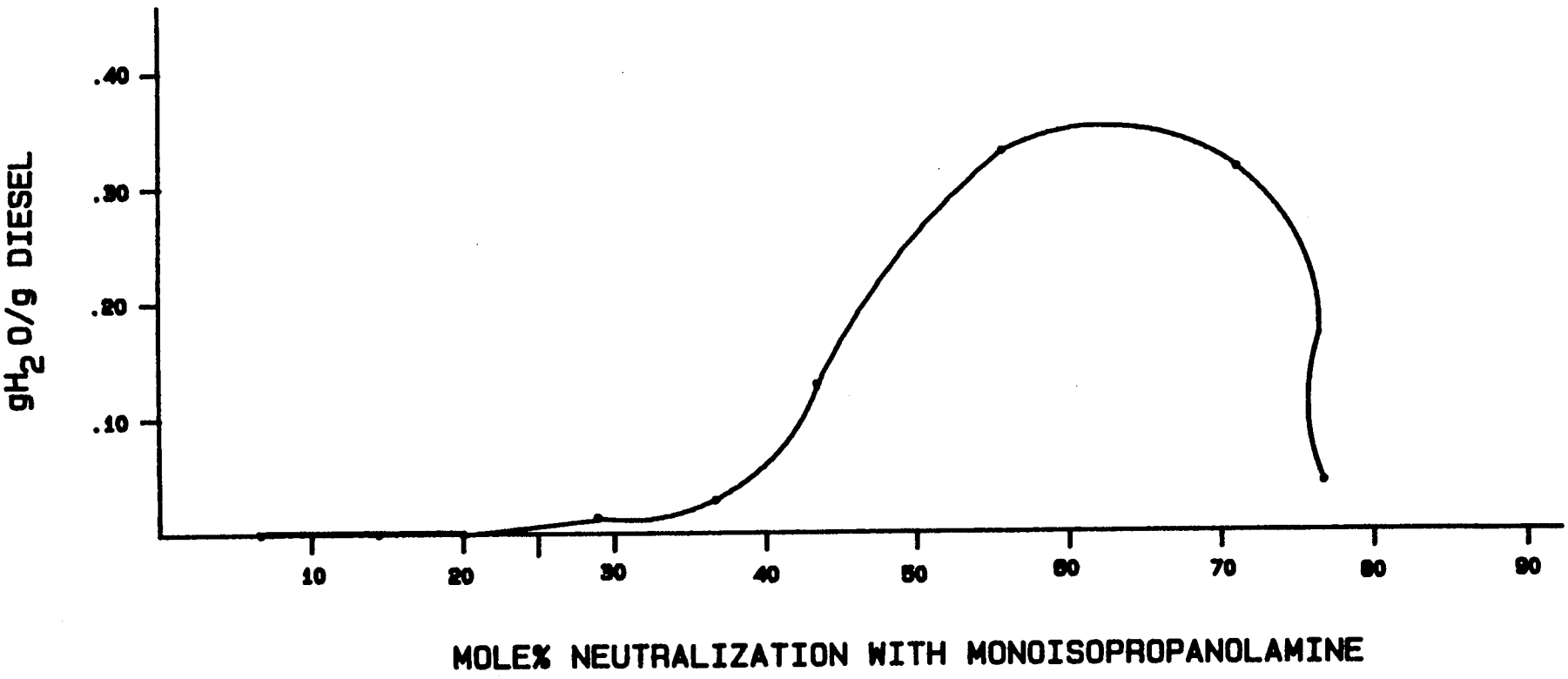

As can be seen from the shape of the curves in FIGS. 1–4, the plot of water uptake versus degree of neutralization demonstrates a sharply defined area of stable microemulsions with high water content. The precise shape of the curve and the absolute values for a particular system are easily determined by the routine type of tests described above. Where there is a distinct peak on the curve of water uptake versus degree of neutralization, the peak value represents the optimum neutralization value for the particular system. Where the curve is flat, for example, as shown in FIG. 3, the optimum neutralization value is the midpoint of the maximum curve value.

TABLE 1

| | | Bases: 0.255 g Emersol 315/g Diesel 0.160 g Methanol/g Diesel Room Temperature | | |
|---|---|---|---|---|
| Example | Neutralizer | Water Uptake (g $H_2O$/g Diesel) | Neutralization of Fatty Acid (Mol %) | Optimum (mol %) |
| 1 | $NH_3$ | 0.20–0.33 | 70–100 | 80 |
| 2 | MEA | 0.15–0.32 | 35–65 | 45 |
| 3 | DMEA | 0.07–0.15 | 25–60 | 42 |
| 4 | MIPA | 0.10–0.35 | 45–80 | 67 |

In order to demonstrate the surprising results achieved by the invention as compared to the teachings of the prior art, experiments were run comparing practice of the invention with the teachings of the art, especially those of U.S. Pat. No. , 4,451,265.

U.S. Pat. No. 4,451,265 shows a phase diagram for water in diesel formulations using Emersol-315 neutralized 105% with DMEA, using ethanol as the cosurfactant. This patent claims that methanol is one of the alcohols suitable as a cosurfactant in the formulations.

A formulation that was in the microemulsion region in the phase diagram using ethanol was chosen (50% diesel, 30% surfactant, 16% alcohol, and 4% water), except that methanol was substituted for ethanol (Example 5). This formulation did not yield a microemulsion; rather it separated into two liquid phases. The same formulation was used (with methanol as the cosurfactant), except that the degree of neutralization with DMEA was reduced to 35 mole % (Example 6). This formulation resulted in a microemulsion, which was stable over temperatures ranging from 0 to 70+° C.

Further experiments were performed to demonstrate the stability of microemulsions using the cosurfactant systems of the invention.

In the examples described in this section, water-in-diesel microemulsions were prepared at room temperature by pipetting the desired amounts of each component into a 16×150 mm culture tube and weighing, using an electronic analytical balance. Nominally 10 grams of each formulation was prepared. The culture tubes containing the microemulsions were placed in thermostated oil baths maintained at −20, −10, 0, 20, 40, 50, 60 or 70° C. The tubes were inspected after standing overnight at temperature. Those that remained a single clear phase at a given temperature were considered to be "stable" microemulsions at that temperature. If a formulation became turbid, or if several layers/phases appeared, the microemulsion was deemed to be "unstable" at that temperature.

Table 2 shows the phase behavior for the samples tested at the various temperatures.

TABLE 2

| Example | 7 | 8 | 9 | 10 | 11 | 12 | 13 | 14 | 6 |
|---|---|---|---|---|---|---|---|---|---|
| Component (% Neutralization) | | | | Wt % in Formulation | | | | | |
| $H_2O$ | — | 5 | 5 | 15 | 5 | 15 | 15 | 20 | 4 |
| MeOH | — | 3 | 5 | 9 | 8 | 9 | 9 | 10 | 16 |
| E-315/MEA (45) | — | 12 | 10 | 16.5 | — | — | — | 20 | — |
| E-315/DMEA (35) | — | — | — | — | 14 | — | — | — | 30 |
| E-215/MIPA (65) | — | — | — | — | — | 16.5 | — | — | — |
| E-315/$NH_3$ (80) | — | — | — | — | — | — | 16.5 | — | — |
| Diesel | 100 | 80 | 80 | 59.5 | 73 | 59.5 | 59.5 | 50 | 50 |
| Temperature (°C.) | | | | Phase Behavior | | | | | |
| −20 | C | P | C | X | (X) | C | FX | FX | C |
| −10 | OK | OK | OK | ↓ | OK | OK | ↓ | ↓ | ↓ |
| 0 | ↓ | ↓ | ↓ | OK | ↓ | ↓ | X | X | OK |
| 20 | ↓ | ↓ | ↓ | ↓ | ↓ | ↓ | OK | OK | ↓ |
| 40 | ↓ | ↓ | X | ↓ | ↓ | ↓ | C | C | ↓ |
| 50 | ↓ | ↓ | ↓ | ↓ | ↓ | ↓ | (X) | P | ↓ |
| 60 | ↓ | ↓ | ↓ | P | (X) | (X) | (X) | P | ↓ |
| 70 | ↓ | ↓ | ↓ | X | X | X | X | X | ↓ |

OK = Clear (may be slightly hazy)
X = Turbid or Phase Separation
F = Frozen
P = Solids precipitated out
C = Cloudy (suspended solids; may settle out slowly)
(X) = Separates into two layers on standing overnight; layers are miscible upon mild shaking The above examples show that w/o microemulsions using methanol as a cosurfactant can have high water loadings and broad temperature stability, provided that the surfactants are anionics that are partially neutralized (within a narrow range of neutralization) with nitrogenous bases without requiring additional surfactants or stabilizers. This is a significant improvement over the prior art, which was largely unsuccessful in using methanol as a cosurfactant. The present invention permits the formulation of lower cost w/o microemulsions by substituting inexpensive methanol for other, more expensive cosurfactant alcohols. It also allows the use of anionic surfactants which are, generally speaking, less costly than other types of surfactants, e.g., nonionics.

The compositions of the present invention are especially advantageous for reducing the emissions from automobile, diesel, and other engines, stationary combustors, turbines, and other devices or processes that rely on the combustion of liquid hydrocarbon fuels. Both the water and the methanol in the formulations contribute to reduced combustion temperatures (reducing NOx emissions) and to "microexplosion" atomization and combustion of the fuels (reducing particulates) and may improve thermal efficiency as well.

While the examples given above were based on diesel fuel and only one source of fatty acid, it is evident to those skilled in the art that the concept of the present invention is applicable to other hydrocarbon sources or fuels, e.g., gasoline, jet fuel, naphtha, fuel oil, petroleum fractions, coal-derived liquids, pure hydrocarbons, etc., and other fatty acids.

With regard to specific amounts of the methanol and partially neutralized fatty acid cosurfactants which are employed, generally the weight ratio of partially neutralized fatty acid to methanol will be in the range 0.5:1 to 8.0:1, and is perferably in the range 1.5:1 to 4.0:1.

As above indicated, the water content of the microemulsion is 2 to 40 wt % of the final composition most preferably 5 to 20 wt %. The ratio of the methanol and partially neutralized fatty acid surfactant system to water in the microemulsion formulation is greater than 0.5:1 and preferably is in the range 1.5–4.0:1.

We claim:

1. A microemulsion fuel composition consisting essentially of:

(a) at least 50% of weights of a petroleum hydrocarbon fuel;

(b) about 2.0 to about 40% by weight water; and (c) a surface active amount of a surfactant consisting essentially of a combination of (1) methanol and (2) fatty acid partially neutralized to within 20 mol % of the optimum netralization value with a nitrogenous base selected from ammonia, (mono) ethanol amine or (mono) isopropanol amine; the weight ratio of partially neutralized fatty acid to methanol being in the range 0.5:1 to 8.0:1.

2. The composition of claim 1 wherein the hydrocarbon fuel is a diesel hydrocarbon fuel.

3. The composition of claim 1 wherein the hydrocarbon fuel is jet fuel.

4. The composition of claim 1 wherein the hydrocarbon fuel is fuel oil.

5. The composition of claim 1 wherein the hydrocarbon fuel is gasoline.

6. The composition of claim 1 wherein the ratio of surfactant to water is at least 0.5:1.

7. The composition of claim 1 wherein the ratio of surfactant to water is 1.5–4.0:1.

8. The composition of claim 1 wherein the fatty acid is 70–100 mol % neutralized with ammonia.

9. The composition of claim 1 wherein the fatty acid is 35–65 mol % neutralized with (mono) ethanol amine.

10. The composition of claim 1 wherein the fatty acid is 45–80 mol % neutralized with (mono) isopropanol amine.

* * * * *